US009704368B2

(12) United States Patent
Dehart

(10) Patent No.: US 9,704,368 B2
(45) Date of Patent: Jul. 11, 2017

(54) PERSONAL ALARM SYSTEM

(71) Applicant: Stacy Dehart, Eugen, OR (US)

(72) Inventor: Stacy Dehart, Eugen, OR (US)

( * ) Notice: Subject to any disclaimer, the term of this patent is extended or adjusted under 35 U.S.C. 154(b) by 0 days.

(21) Appl. No.: 14/964,637

(22) Filed: Dec. 10, 2015

(65) Prior Publication Data

US 2017/0169684 A1 Jun. 15, 2017

(51) Int. Cl.
*G08B 21/02* (2006.01)
*G08B 3/10* (2006.01)

(52) U.S. Cl.
CPC ..... *G08B 21/02* (2013.01); *G08B 3/10* (2013.01)

(58) Field of Classification Search
CPC ..... G08B 15/004; G08B 21/02; G08B 3/10; G08B 25/016
See application file for complete search history.

(56) References Cited

U.S. PATENT DOCUMENTS

| | | | | |
|---|---|---|---|---|
| 7,375,638 | B2 | 5/2008 | Light et al. | |
| 7,535,357 | B2 | 5/2009 | Enitan et al. | |
| D600,003 | S | 9/2009 | Kahng | |
| 7,665,684 | B2 | 2/2010 | Salentine et al. | |
| 8,013,734 | B2 | 9/2011 | Saigh et al. | |
| 2013/0069766 | A1 | 3/2013 | Sorge | |
| 2013/0120144 | A1* | 5/2013 | Runciman | G08B 13/1436 340/571 |
| 2013/0260825 | A1 | 10/2013 | Hagenstad | |
| 2013/0278413 | A1 | 10/2013 | Kamath et al. | |
| 2014/0247124 | A1 | 9/2014 | Ros | |
| 2016/0140816 | A1* | 5/2016 | Gulick | G08B 13/149 455/575.8 |

* cited by examiner

*Primary Examiner* — Curtis Odom

(57) ABSTRACT

A personal alarm system includes an electronic device that may be carried. The electronic device has an output port. An alarm is removably coupled to the electronic device and the alarm may be manipulated. The alarm is selectively turned on such that the alarm emits an audible alarm. Thus, the alarm may alert an observer to provide assistance. The alarm is turned on when the alarm is removed from the electronic device.

5 Claims, 3 Drawing Sheets

PERSONAL ALARM SYSTEM

BACKGROUND OF THE DISCLOSURE

Field of the Disclosure

The disclosure relates to alarm devices and more particularly pertains to a new alarm device for coupling an audible alarm to an electronic device.

SUMMARY OF THE DISCLOSURE

An embodiment of the disclosure meets the needs presented above by generally comprising an electronic device that may be carried. The electronic device has an output port. An alarm is removably coupled to the electronic device and the alarm may be manipulated. The alarm is selectively turned on such that the alarm emits an audible alarm. Thus, the alarm may alert an observer to provide assistance. The alarm is turned on when the alarm is removed from the electronic device.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
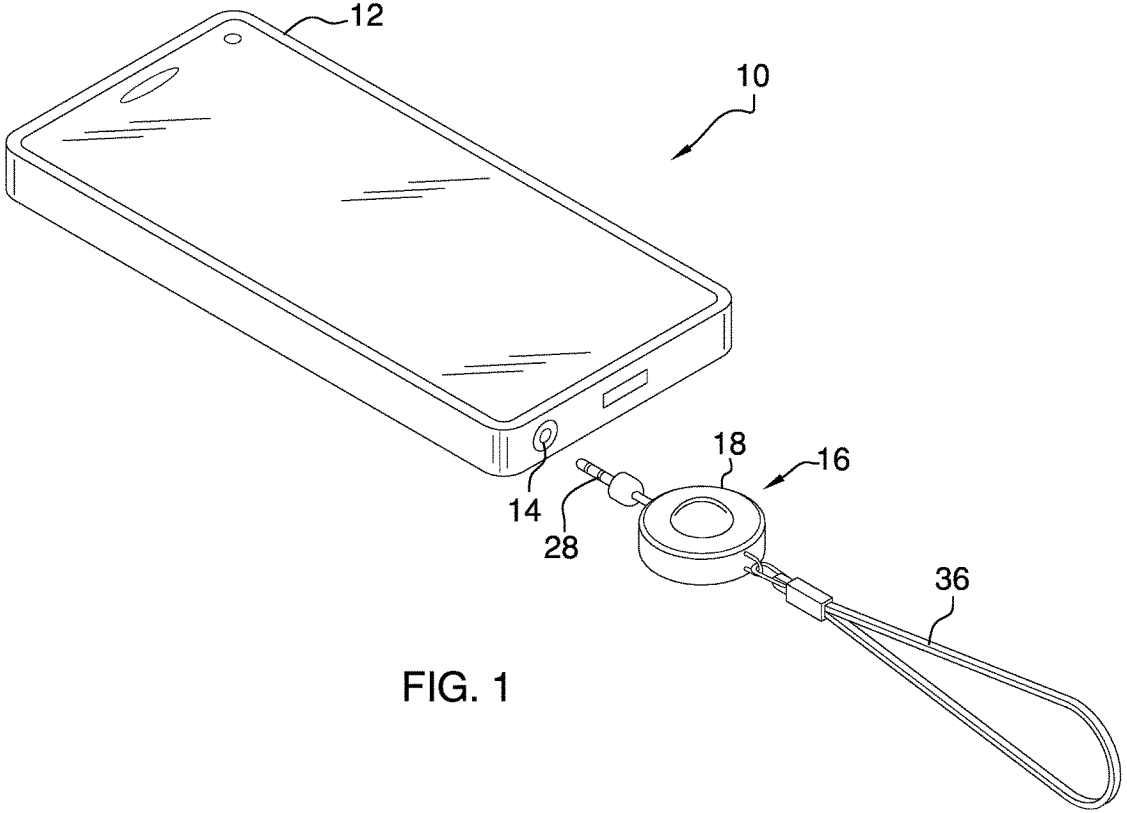
FIG. 1 is a perspective in-use view of a personal alarm system according to an embodiment of the disclosure.
Figure 2:
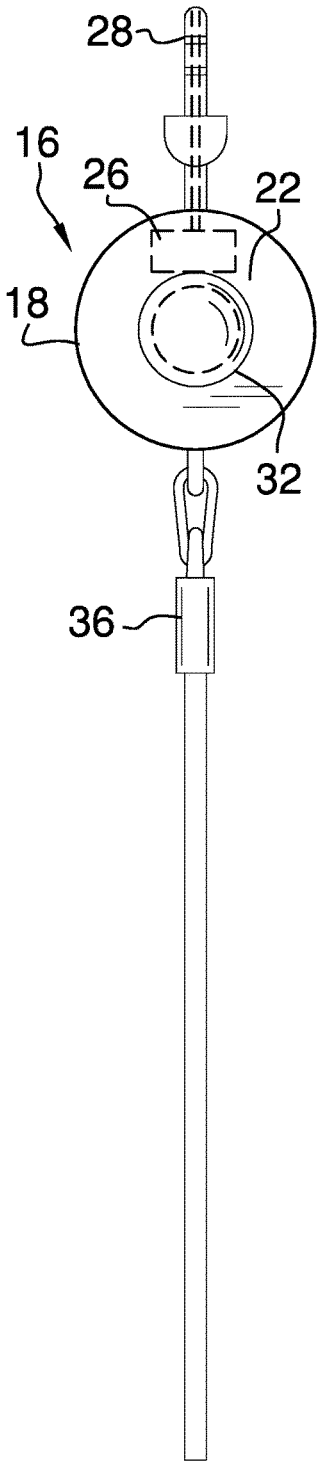
FIG. 2 is a back view of an embodiment of the disclosure.
Figure 3:
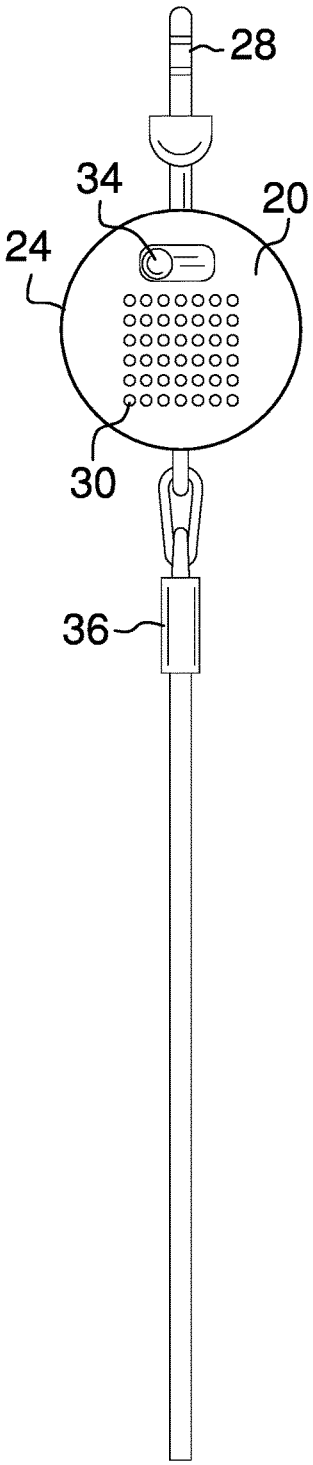
FIG. 3 is a front view of an embodiment of the disclosure.
Figure 4:
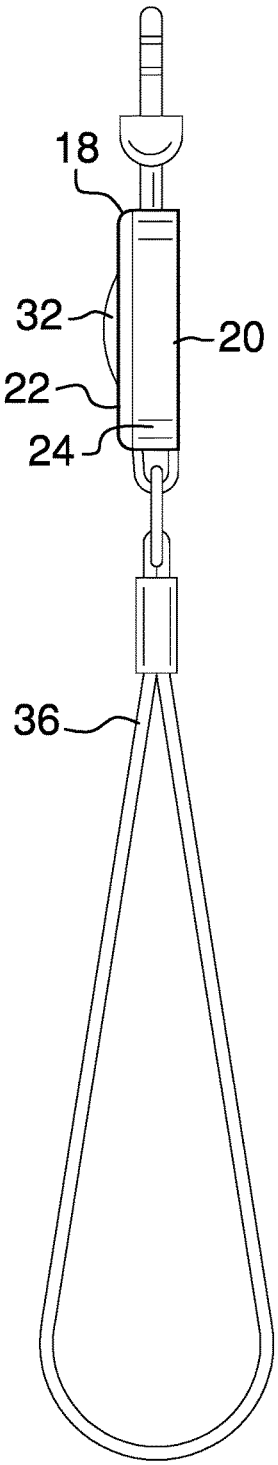
FIG. 4 is a right side view of an embodiment of the disclosure.
Figure 5:
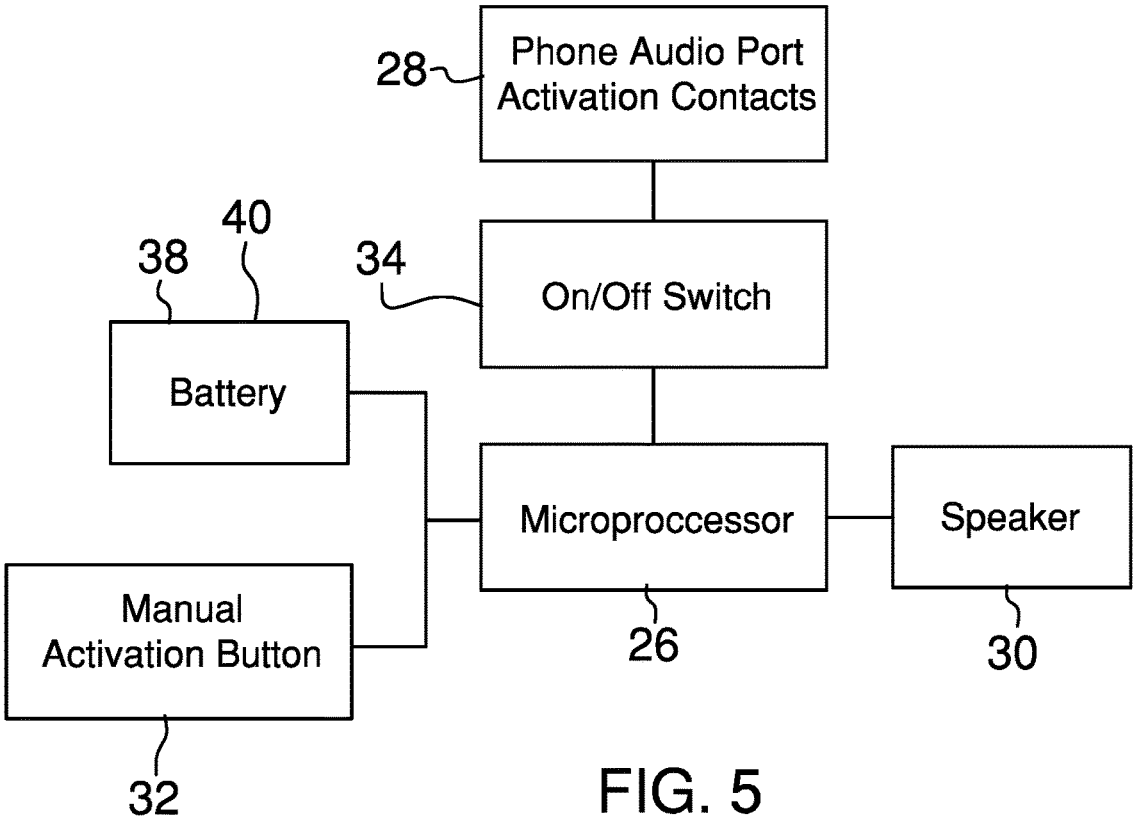
FIG. 5 is a schematic view of an embodiment of the disclosure.

With reference now to the drawings, and in particular to FIGS. 1 through 5 thereof, a new alarm device embodying the principles and concepts of an embodiment of the disclosure and generally designated by the reference numeral 10 will be described.

As best illustrated in FIGS. 1 through 5, the personal alarm system 10 generally comprises an electronic device 12 that may be carried. The electronic device 12 has an output port 14. The electronic device 12 may comprise a smart phone or the like. The output port 14 may comprise a female ¼ inch headphone jack or the like. The electronic device 12 may contain a program or an app.

An alarm 16 is removably coupled to the electronic device 12 and the alarm 16 may be manipulated. The alarm 16 is selectively turned on such that the alarm 16 emits an audible alarm. Thus, the alarm 16 may alert an observer to provide assistance to a user of the alarm 16. The alarm 16 is turned on when the alarm 16 is removed from the electronic device 12. The user may silence the audible alarm at any time.

The alarm 16 comprises a housing 18 that has a first side 20, a second side 22 and a peripheral edge 24 extending between the first side 20 and the second side 22. The peripheral edge 24 may be curved, giving the housing 18 a disk shape. A processor 26 is positioned within the housing 18 and the processor 26 selectively generates an alarm sequence. The processor 26 may comprise an electronic processor or the like.

A plug 28 extends outwardly from the housing 18 and the plug 28 is electrically coupled to the processor 26. The plug 28 is selectively electrically coupled to the output port 14 such the processor 26 is in electrical communication with the electronic device 12. The plug 28 may comprise a male ¼ headphone plug or the like and the plug 28 may be positioned on the peripheral edge 24. The program or the app contained in the electronic device 12 includes instructions for the processor 26. Thus, the processor 26 is notified when the plug 28 is removed from the output port 14.

A speaker 30 is coupled to the housing 18 such that the speaker 30 selectively emits the audible alarm. The speaker 30 is electrically coupled to the processor 26. The speaker 30 emits the audible alarm when the processor 26 generates the alarm sequence. The speaker 30 may be positioned on the first side 20 of the housing 18.

A button 32 is movably coupled to the housing 18 and the button 32 may be manipulated. The button 32 is electrically coupled to the processor 26. Thus, the processor 26 generates the alarm sequence when the button 32 is manipulated. The button 32 may be positioned on the second side 22 of the housing 18.

A switch 34 is movably coupled to the housing 18 and the switch 34 may be manipulated. The switch 34 is electrically coupled to the processor 26 such that the switch 34 turns the processor 26 on and off. The processor 26 generates the alarm sequence when the plug 28 is not electrically coupled to the output port 14 and the switch 34 is turned on. The switch 34 may be positioned on the first side 20 of the housing 18.

A lanyard 36 is coupled to the housing 18. The lanyard 36 may be selectively coupled to the user's wrist or other support. The lanyard 36 may be positioned on the peripheral edge 24 of the housing 18. A power supply 38 is positioned within the housing 18 and the power supply 38 is electrically coupled to the processor 26. The power supply 38 comprises at least one battery 40.

In use, the plug 28 is plugged into the output port 14 when the electronic device 12 is carried while walking. The button 32 is manipulated when the user feels threatened and when the user needs assistance. The speaker 30 emits the audible alarm when the button 32 is manipulated. The audible alarm is silenced when the switch 34 is turned off. The speaker 30 emits the audible alarm when the plug 28 is removed from the output port 14 while the switch 34 is turned on. Thus, the speaker 30 emits the audible alarm when the electronic device 12 is forcibly taken from the user.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A personal alarm system comprising:

an electronic device being configured to be carried, said electronic device having an output port; and an alarm being removably coupled to said electronic device wherein said alarm is configured to be manipulated, said alarm being selectively turned on such that said alarm emits an audible alarm wherein said alarm is configured to alert an observer to provide assistance, said alarm being turned on when said alarm is removed from said electronic device, wherein said alarm comprises a housing having a first side, a second side and a peripheral edge extending between said first side and said second side, and a processor being positioned within said housing, said processor selectively generating an alarm sequence;

a plug extending outwardly from said housing, said plug being electrically coupled to said processor, said plug being selectively electrically coupled to said output port such said processor is in electrical communication with said electronic device; and a switch being movably coupled to said housing wherein said switch is configured to be manipulated, said switch being electrically coupled to said processor such that said switch turns said processor on and off, said processor generating said alarm sequence when said plug is not electrically coupled to said output port and said switch is turned on.

2. The system according to claim 1, further comprising a speaker being coupled to said housing such that said speaker selectively emits said audible alarm, said speaker being electrically coupled to said processor such that said speaker emits said audible alarm when said processor generates said alarm sequence.

3. The system according to claim 1, further comprising a button being movably coupled to said housing wherein said button is configured to be manipulated, said button being electrically coupled to said processor such that said processor to generates said alarm sequence when said button is manipulated.

4. The system according to claim 1, further comprising:

a lanyard being coupled to said housing, said lanyard being configured to be selectively coupled to a support; and a power supply being positioned within said housing, said power supply being electrically coupled to said processor, said power supply comprising at least one battery.

5. A personal alarm system comprising:

an electronic device being configured to be carried, said electronic device having an output port; and an alarm being removably coupled to said electronic device wherein said alarm is configured to be manipulated, said alarm being selectively turned on such that said alarm emits an audible alarm wherein said alarm is configured to alert an observer to provide assistance, said alarm being turned on when said alarm is removed from said electronic device, said alarm comprising:

a housing having a first side, a second side and a peripheral edge extending between said first side and said second side, a processor being positioned within said housing, said processor selectively generating an alarm sequence, a plug extending outwardly from said housing, said plug being electrically coupled to said processor, said plug being selectively electrically coupled to said output port such said processor is in electrical communication with said electronic device, a speaker being coupled to said housing such that said speaker selectively emits said audible alarm, said speaker being electrically coupled to said processor such that said speaker emits said audible alarm when said processor generates said alarm sequence, a button being movably coupled to said housing wherein said button is configured to be manipulated, said button being electrically coupled to said processor such that said processor to generates said alarm sequence when said button is manipulated, a switch being movably coupled to said housing wherein said switch is configured to be manipulated, said switch being electrically coupled to said processor such that said switch turns said processor on and off, said processor generating said alarm sequence when said plug is not electrically coupled to said output port and said switch is turned on, a lanyard being coupled to said housing, said lanyard being configured to be selectively coupled to a support, and a power supply being positioned within said housing, said power supply being electrically coupled to said processor, said power supply comprising at least one battery.

* * * * *